US010647120B2

(12) United States Patent
Stefani et al.

(10) Patent No.: US 10,647,120 B2
(45) Date of Patent: May 12, 2020

(54) NOZZLE FOR INK-JET PRINTERS

(71) Applicant: SYSTEM S.P.A., Fiorano Modenese (Modena) (IT)

(72) Inventors: Franco Stefani, Sassuolo (IT); Mohamed Ouassif, Serramazzoni (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 0 days.

(21) Appl. No.: 16/301,533

(22) PCT Filed: Jun. 13, 2017

(86) PCT No.: PCT/IB2017/053488
§ 371 (c)(1),
(2) Date: Nov. 14, 2018

(87) PCT Pub. No.: WO2017/216713
PCT Pub. Date: Dec. 21, 2017

(65) Prior Publication Data

US 2019/0283417 A1 Sep. 19, 2019

(30) Foreign Application Priority Data

Jun. 17, 2016 (IT) ..... 102016000062755

(51) Int. Cl.
*B41J 2/14* (2006.01)
*B41J 2/04* (2006.01)

(52) U.S. Cl.
CPC ..... *B41J 2/1433* (2013.01); *B41J 2/14* (2013.01); *B41J 2002/041* (2013.01); *B41J 2202/05* (2013.01)

(58) Field of Classification Search
CPC ..... B41J 2/1433; B41J 2/14; B41J 2/14201; B41J 2/14314
USPC ..... 347/20, 45, 47, 54
See application file for complete search history.

(56) References Cited

U.S. PATENT DOCUMENTS

| | | | |
|---|---|---|---|
| 10,016,977 | B2 | 7/2018 | Stefani et al. |
| 2017/0087837 | A1 | 3/2017 | Stefani et al. |

FOREIGN PATENT DOCUMENTS

| | | |
|---|---|---|
| EP | 2842753 | 3/2015 |
| GB | 2529511 | 2/2016 |
| WO | 2015186014 | 12/2015 |

*Primary Examiner* — An H Do
(74) *Attorney, Agent, or Firm* — Pearne & Gordon LLP

(57) ABSTRACT

An ejector for ink-jet printers, comprising a main body (2) and a through hole (3), arranged through the main body (2), which has a surface (4). At least the surface (4) of the through hole (3) is made of an elastic material.

10 Claims, 4 Drawing Sheets

NOZZLE FOR INK-JET PRINTERS

The present invention relates to an ejector for ink-jet printers.

The ejector according to the present invention is particularly useful, but not exclusively, for ink-jet printers that use ceramic enamel or ink.

As it is known, the ceramic enamels used for ink-jet printing are extremely abrasive.

For this reason, the ejectors currently available for dispensing ceramic enamels are provided with extremely hard, structured surfaces, made with materials suitable for withstanding the erosive action of enamels.

The processing necessary for obtaining the necessary dimensional and structural precision of the ejectors is consequently very costly. Furthermore, the ejectors currently available get occluded rather frequently due to the particles that are suspended in the enamels.

The aim of the present invention is to offer an ejector for ink-jet printers which allows the drawbacks of the currently available ejectors to be obviated.

In summary, the ejector according to the present invention solves the problem of resistance to abrasive action of ceramic enamels by overturning the solutions proposed in the sector up to now. In fact, the ejector according to the present invention, rather than having surfaces with a high hardness, is made of flexible and deformable material, for example elastomeric and/or silicone material. The applicant has found that, as well as being resistant to the abrasion of enamels, materials of this type guarantee the same operating precision as the hard or hardened materials currently used. Furthermore, the processes that can be used are much quicker and cheaper than those currently used for hard or hardened materials.

An example of prior art ejectors which partly solves the above summarized drawbacks is disclosed in publication GB 2529511 A.

Further characteristics and advantages of the present invention will become more apparent in the following detailed description of an embodiment of the present invention, illustrated by way of non-limiting example in the attached figures, in which.

Figure 1:
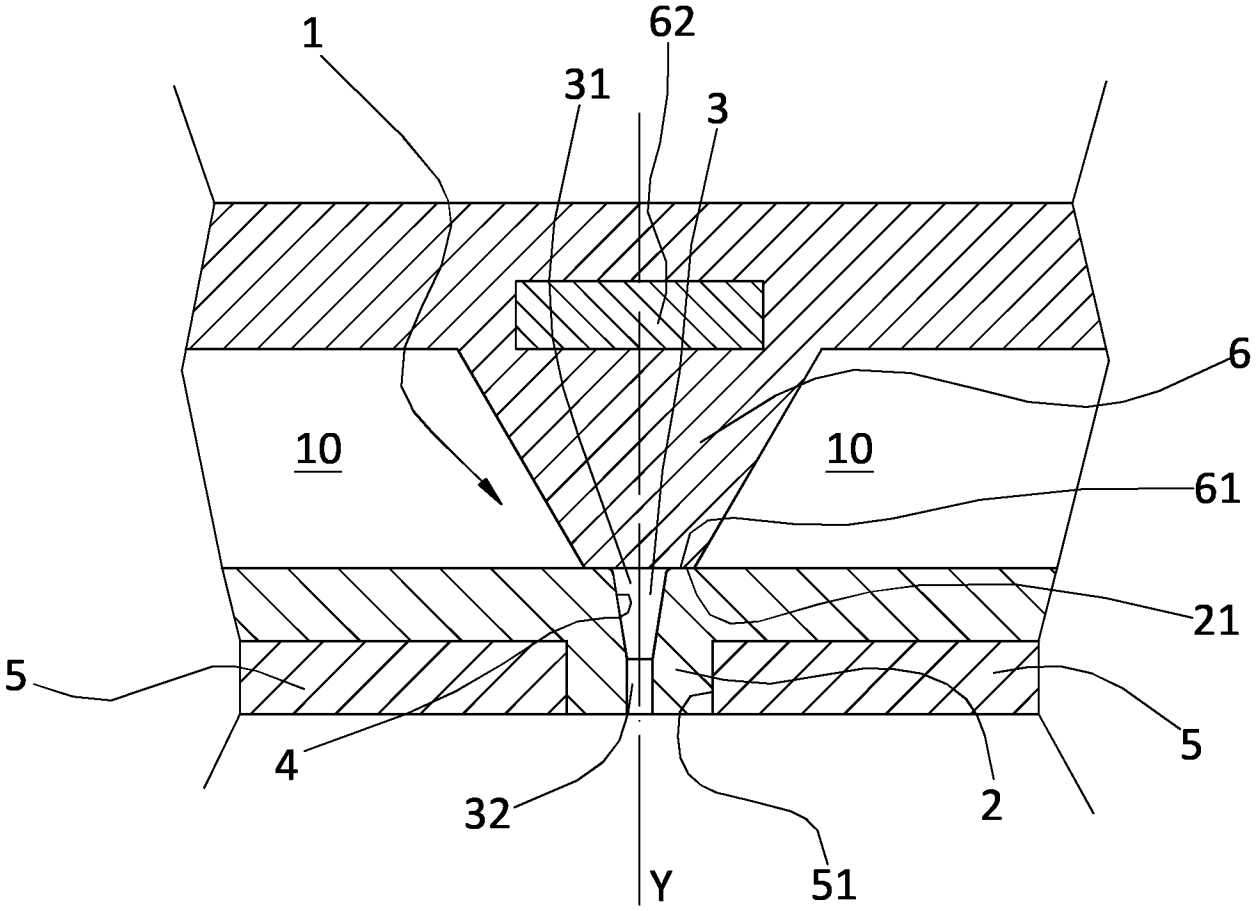
FIG. 1 shows a schematic sectional view of an ejector according to the present invention.

The ejector for printers according to the present invention comprises a main body (2), through which a through hole (3) is arranged.

Preferably, the through hole (3) is equipped with a longitudinal axis (Y) and has, with respect to such axis, an axial symmetry conformation. For example, in a preferred, not exclusive, embodiment, the through hole (3) has a first portion (31) having a conical conformation and a second portion (32) having a cylindrical conformation. Both portions (31,32) are concentric to the longitudinal axis (Y).

The through hole (3) has a surface (4) in contact with which the printing fluid flows, which is intended to be dispensed through the through hole (3).

Advantageously, such surface (4), at least for a determined thickness, is made of an elastic material. For example, a layer of elastic material, of a determined thickness, can be used for coating the surface (4) of the through hole (3). Alternatively, the main body (2), through which the through hole (3) is arranged, can be made of an elastic material at least for a portion that comprises the surface (4) of the through hole (3). This means that a determined thickness of the main body (2) that surrounds the through hole (3) is made of elastic material.

In a preferred, but not exclusive, embodiment of the ejector, the main body (2) is entirely made of an elastic material.

Rather than having surfaces equipped with high hardness like ejectors of the known type, the ejector according to the present invention is therefore made of elastic material, i.e. of a material that can be elastically deformed. This allows the abrasion resistance to be notably increased, since the surface (4) of the through hole (3) is free to be elastically deformed in response to the pressure exerted by the abrasive particles of the enamel, without undergoing any substantial abrasion. Furthermore, the elasticity of the surface (4) and/or of the main body (2) facilitates the removal of any accumulations of particles that could occlude the through hole (3). This is because an increase in the pressure of the printing fluid, due to a possible occlusion, would lead to the elastic deformation of the surface (4) and the discharge of the occlusion.

Preferably, the elastic material of which the surface (4) and the main body (2) may be made of have a Shore A hardness comprised between 20 and 90. In that Shore A hardness interval, the advantages connected with the use of an elastic material are substantially increased. Within such interval, a Shore A hardness of about 40 is particularly advantageous.

The elastic material comprises, for example, an elastomeric material and/or a rubbery material.

The use of an elastic material that comprises a silicone material or silicone-type material is particularly advantageous. In fact, silicone materials have some affinity with ceramic enamels and, for this reason, they drastically reduce the possibility of accumulations of enamel and occlusions being able to form. Silicone materials particularly suitable for the purposes are silicones of the RTV type. In fact, these materials are suitable for being processed through injection moulding, with low injection pressures. This allows moulds with very thin cores and inserts to be used, which are suitable for the creation of the ejector according to the present invention, as will be better illustrated in the following description.

A further possible embodiment of the ejector envisages the use of an elastic material comprising polypropylene.

In a possible embodiment, the ejector according to the present invention comprises a support body (5), associated with the main body (2). The support body (5) can be made of a notably more rigid material than the elastic material used for the creation of the surface (4) of the through hole (3) and/or of the main body (2). The support body (5) can be made of a metallic material, for example steel.

The support body (5) contributes to containing deformations of the main body (2). For that purpose, an embodiment in which the support body (5) has a seat (51) in which the main body (2) is at least partially arranged is particularly advantageous. In such configuration the main body (2) can be entirely made of an elastic material as described above.

Figure 3:
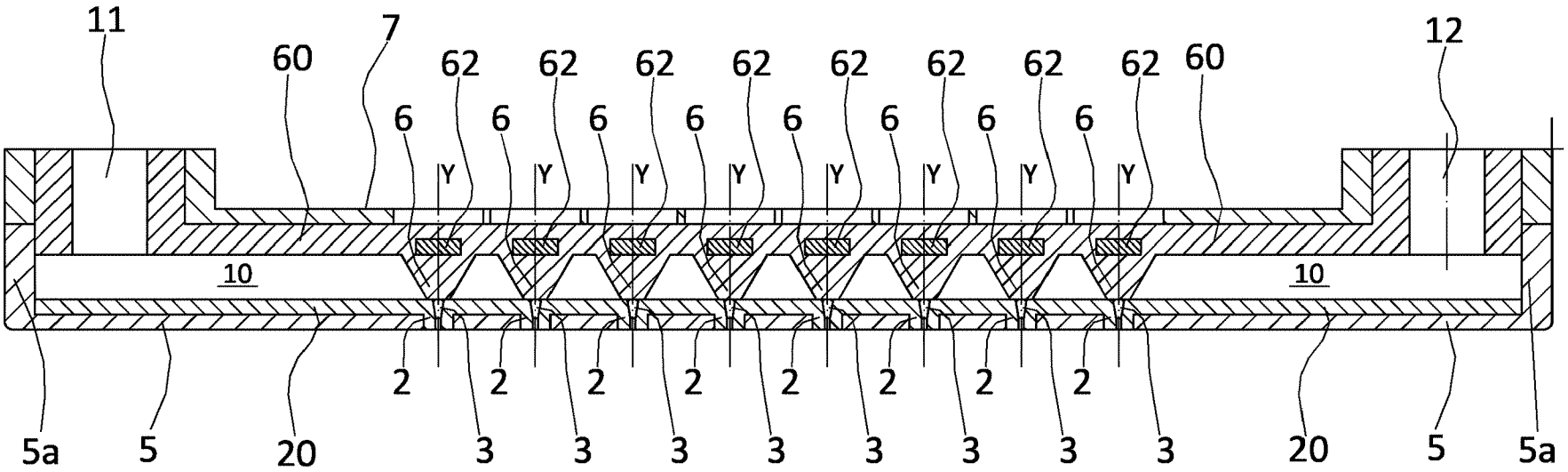
FIG. 3 shows a sectional view of the printhead of FIG. 2, according to the plane of trace III-III

FIG. 3 shows a set of ejectors according to the present invention. Two or more ejectors (1) exhibit main bodies (2) which are associated with one another, in a single piece, in a body of ejectors (20). Advantageously, the body of ejectors (20) can be made of an elastic material of the type already described previously in relation to a single ejector (1). The body of ejectors (20) therefore comprises two or more main bodies (2) through each of which a through hole (3) is arranged.

Figure 2:
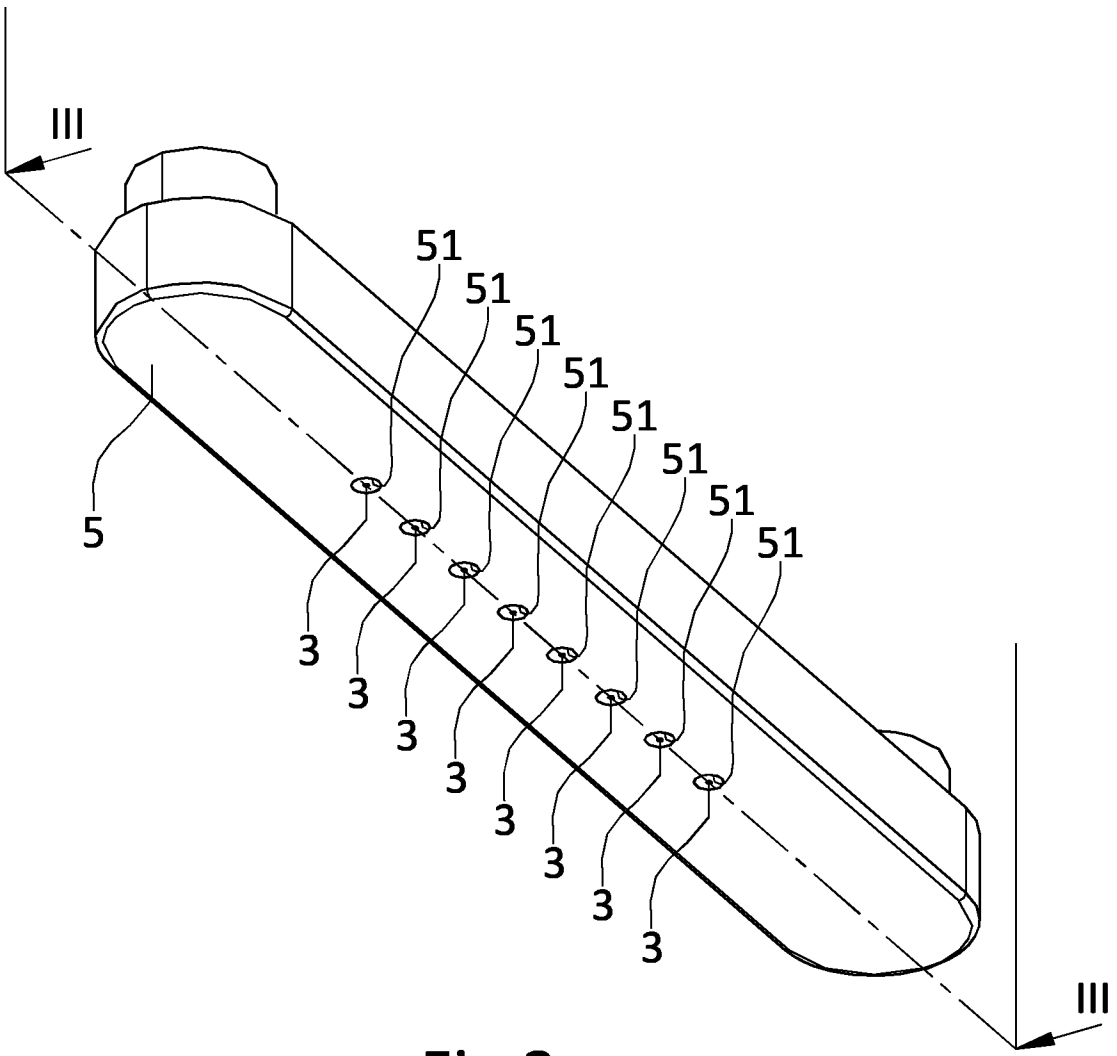
FIG. 2 shows an axonometric view of a printhead according to the present invention.

In the embodiment of FIG. 2, the body of ejectors (20) exhibits overall a flat conformation, substantially in the form of a membrane, from which the main bodies (2) of the various ejectors (1) project. Preferably, each main body (2) has a cylindrical conformation, concentric to its own longitudinal axis (Y).

The set of ejectors illustrated in FIG. 3 comprises a support body (5) equipped with two or more seats (51) in each of which, a main body (2) is housed, at least in part. The support body (5), in this embodiment, exhibits a flat conformation.

Preferably, but not exclusively, the ejectors (1) are aligned on the same plane that contains the longitudinal axes (Y) of the through holes (3). The ejectors (1) therefore define a row in which the longitudinal axes (Y) are coplanar. Other arrangements of the ejectors (1) are obviously possible.

Overall, the set of ejectors according to the present invention is structurally defined by the body of ejectors (20) and the support (5) associated thereto. The set of ejectors may be used to create a printhead, illustrated in FIG. 3.

The printhead comprises a feeding conduit (10) for a printing fluid. Such feeding conduit (10) exhibits an inlet opening (11) and an outlet opening (12) for the printing fluid and is delimited, at least partially, by a closing body (7). A set of ejectors (1) according to the present invention is associated with the feeding conduit (10) so that the through holes (3) are in communication with the feeding conduit (10). The fluid circulating in the feeding conduit (10) may be dispensed out of the feeding conduit (10) itself by means of the through holes (3). In a preferred embodiment of the printhead, the feeding conduit (10) is closed, at least in part, by the body of ejectors (20). In particular, the feeding conduit (10) is closed by a body of ejectors according to the present invention. As shown schematically in FIG. 2, the support body (5) can be conformed with one or more connecting portions (5*a*), structured to allow the connection to the closing body (7). The feeding conduit (10) is therefore delimited substantially by the closing body (7) and by the support body (5), which can be connected to the closing body (7) through its own connecting portions (5*a*). The feeding conduit (10) is in communication with the outside only by means of the through holes (3) of the ejectors (1) and the inlet and outlet openings (11,12).

As illustrated in FIG. 1, the ejector according to the present invention may be equipped with a shutter (6), being movable between a closed configuration, in which it occludes the through hole (3), and an open configuration, in which it does not occlude the through hole (3). The shutter (6) has a front surface (61), arranged substantially perpendicular to the longitudinal axis (Y), which is intended to be placed in contact with a front end surface (21) of the main body (2) and the through hole (3) in the closed position, as illustrated in FIG. 1. In the open configuration, the shutter (6) is lifted and removed from the front end surface of the main body (2) and of the through hole (3). By way of example, the shutter (6) may have a truncoconical conformation with its vertex facing towards the through hole (3).

In ejectors of the known type, the main body (2) and the shutter (6) are made of hardened materials or materials with high hardness. This obliges the front surface (61) of the shutter and the front end surface (21) of the main body to be made with great precision. Such two surfaces must be perfectly parallel, so as to be perfectly superimposed in the closed position of the shutter (6), to be able to perform the perfect closing of the through hole (3).

In the ejector according to the present invention, the use of an elastic material for making the main body (2) allows the field of tolerance to be extended for the creation of the shutter (6). In particular, any faults on the front surface (61) and/or not perfectly perpendicular positioning in relation to the longitudinal axis (Y) may be compensated by the elastic deformation of the front end surface (21) of the main body (2). This allows the production costs of the ejector and the printhead to be notably reduced.

In a particularly advantageous embodiment, the shutter (6) is also made of an elastic material, preferably having Shore A hardness comprised between 20 and 90. Also for the shutter (6) all the advantages already described in relation to the surface (4) and to the main body (2) are repeated, connected with the use of an elastic material. Preferably, the elastic material used for the creation of the shutter (6) has a lower Shore A hardness than that of the elastic material used for the creation of the surface (4) or of the main body (2) of the ejector.

In a particularly advantageous embodiment, illustrated in patent application WO2015186014 by the same applicant, the shutter (6) comprises at least one sensitive element (62) made of a material suitable for interacting with a magnetic field for the movement of the shutter itself. The sensitive element (62) is for example a magnet. Preferably, an electromagnetic activation means, not shown, may be configured to generate a first attractive magnetic field and a second repulsive magnetic field of the sensitive element (62) realised as a permanent magnet, to move the shutter (6) between the closed and the open position. Preferably, the sensitive element (62) is arranged inside the shutter (6), i.e. it is incorporated into the shutter (6).

In the printhead according to the present invention, illustrated in FIG. 3, the shutters (6) are associated with one another, in a single piece, in a body of shutters (60).

Such body of shutters (60) delimits, at least in part, the feeding conduit (10). Furthermore, the body of shutters (60) is interposed between the feeding conduit (10) and the electromagnetic activation means (not illustrated). Each shutter (6) is solidly constrained to the body of shutters (60) in the opening and/or closing movement of its own through hole (3). Preferably, the sensitive elements (62) of the shutters (6) are arranged within the body of shutters (60).

As shown in FIG. 3, the body of shutters (60) may be provided with two substantially cylindrical end portions, through which the inlet opening (11) and the outlet opening (12) are afforded. In this way, the openings (11,12) may be made of the same material of which the body of shutters (60) is made. The end portions of the body of shutters (60) are arranged within seats afforded in the closing body (7), so that the openings (11,12) are accessible from outside the printhead. The openings (11,12) are predisposed to be connected to a feeding circuit, not illustrated, for feeding the printing liquid.

The body of shutters (60) is also interposed between the closing body (7) and the feeding conduit (10). The closing body (7) may be provided with a plurality of through openings, substantially aligned with the shutters (6), which allow the deformation of the body of shutters (60), in particular in the opening stroke of the shutters (6). In substance, the printhead according to the present invention comprises an outer casing, defined by the support body (5) and by the closing body (7) connected to one another, inside which the body of ejectors (20) and the body of shutters (60)

are placed. The printhead is therefore exhibited as a single body, and can be easily associated with a printer.

A set of ejectors according to the present invention may be performed with a method that envisages the following steps.

The method is substantially an injection moulding method.

Figure 4:
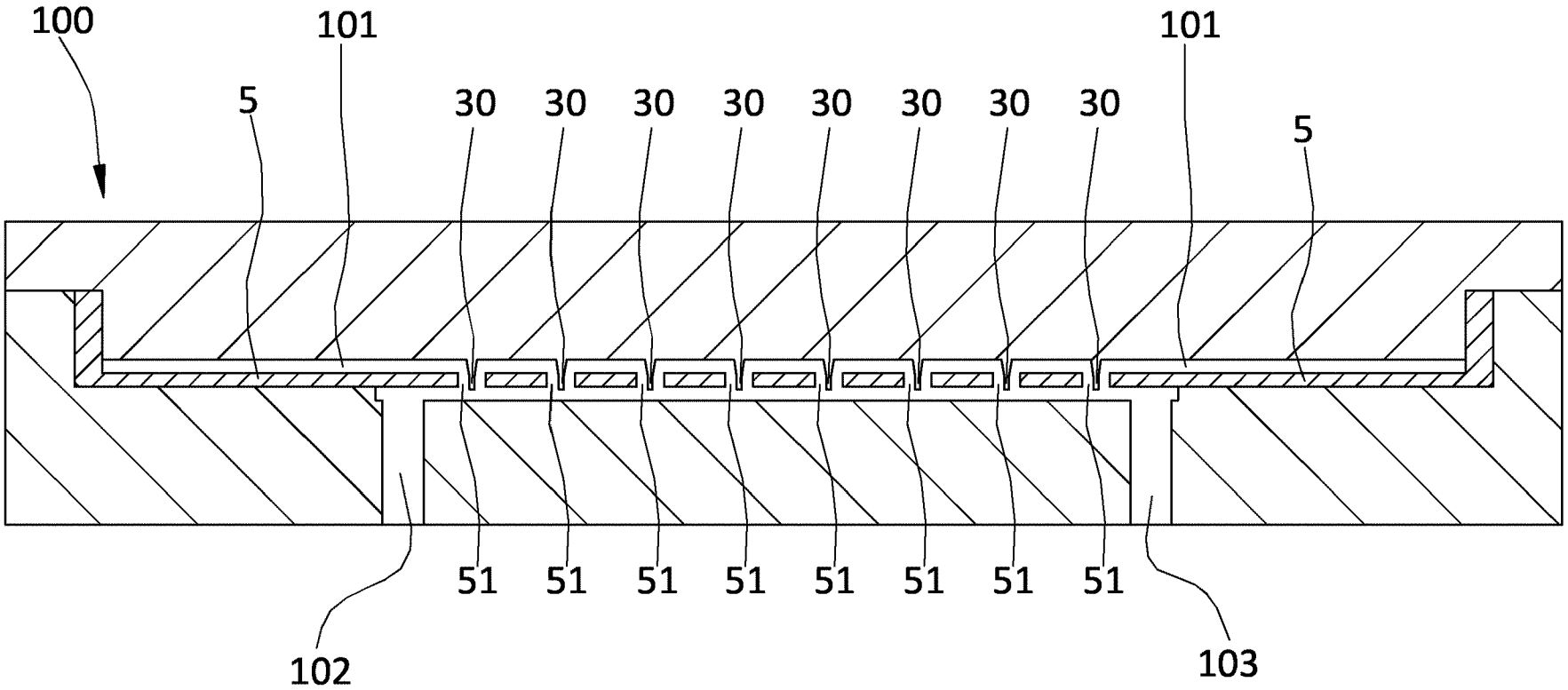
FIG. 4 shows a schematic sectional view of a mould that can be used for making a set of ejectors according to the present invention.

The mould (100), depicted in FIG. 4, is equipped with a main chamber (101) within which one or more projecting shapes (30) are projecting, each of which positively reproduces the shape of a through hole (3). The mould (100) is equipped with one or more injection channels (102,103) for the introduction of material into the main chamber (101).

Within the main chamber the support body (5) is arranged so that each seat (51) surrounds, at least partially, a projecting shape (30).

The elastic or elastomeric material, in the molten state, is then injected into the mould. The support body (5) and the projecting shapes (30) are incorporated into the elastic or elastomeric material in the molten state. The material is then made to solidify, assuming its elastic or elastomeric characteristics.

After solidification, the elastic material is removed from the mould. The support body (5) is incorporated into the material itself, so that the through holes (3) are occluded at one end. In substance, upon extraction from the mould, a layer of elastic material covers the support (5) on the opposite side to where the projecting shapes (30) are located. This layer can be removed through a cutting process, flush with the support body (5), which truncates the ends of the main bodies (2) flush with the support body (5) and frees the through holes (3).

Therefore, the ejector according to the present invention solves the problem of resistance to abrasive action of ceramic enamels by overturning the solutions proposed in the sector up to now. In fact, the ejector according to the present invention, rather than having surfaces with a high hardness, is made of flexible and deformable material, for example elastomeric and/or silicone material. The applicant has found that, as well as being resistant to the abrasion of enamels, materials of this type are suitable for being processed substantially with the same precision as the hard or hardened materials currently used, but with much quicker and cheaper processes.

The invention claimed is:

1. A printhead comprising: a feeding conduit (10) for a printing fluid and a set of ejectors (1); wherein each ejector (1) comprises: a main body (2), made of an elastomeric material; a through hole (3) arranged through the main body (2), concentric to a longitudinal axis (Y), which exhibits a surface (4); a shutter (6), movable between a closed configuration, in which it blocks the through hole (3), and an open configuration, in which it does not block the through hole (3), wherein the shutter (6) is made of elastomeric material;

characterized in that:

the through holes (3) are in communication with the feeding conduit (10);

the feeding conduit (10) is closed, at least partly, by a plate (20), wherein the main bodies (2) of the ejectors (1) are afforded in a single piece;

the shutters (6) are mutually afforded in a single piece within a body of shutters (60), and wherein the feeding conduit (10) is closed at least partly, by the body of the shutters (60).

2. The printhead according to claim 1, wherein the shutter (6) exhibits a front surface (61), arranged substantially perpendicular to the longitudinal axis (Y), which is intended to be placed in contact with a front end surface (21) of the main body (2) and of the through hole (3) in the closed position.

3. The printhead according to claim 1, wherein said elastomeric material exhibits a Shore A hardness comprised between 20 and 90.

4. The printhead according to claim 1, wherein said elastomeric material exhibits a Shore A hardness of about 40.

5. The printhead according to claim 1, wherein said elastomeric material comprises a silicone material.

6. The printhead according to claim 1, wherein said elastomeric material comprises polypropylene.

7. The printhead according to claim 1, comprising a support body (5) associated to the main body (2).

8. The printhead according to claim 7, wherein the support body (5) exhibits a seat in which the main body (2) is disposed at least partially.

9. The printhead according to claim 8, comprising a support body (5) provided with two or more seats in each of which a main body (2) is at least partially housed.

10. The printhead according to claim 1, in which the ejectors (1) are aligned on a same plane that contains the longitudinal axes (Y) of the through holes (3).

* * * * *